US005615889A

United States Patent [19]

Long

[11] Patent Number: 5,615,889

[45] Date of Patent: Apr. 1, 1997

[54] SOCCER GOAL PRACTICE NET

[76] Inventor: Phillip E. Long, 412 NW. 279th St., Ridgefield, Wash. 98642

[21] Appl. No.: 590,595

[22] Filed: Jan. 24, 1996

[51] Int. Cl.[6] ..... A63B 69/00

[52] U.S. Cl. ..... 273/396

[58] Field of Search ..... 273/394, 395, 273/396, 400, 411, 57.2

[56] References Cited

U.S. PATENT DOCUMENTS 4,921,257 5/1990 Heller ..... 273/411 X

*Primary Examiner*—William H. Grieb

*Attorney, Agent, or Firm*—Miller Nash Wiener Hager & Carlsen LLP

[57] ABSTRACT

The invention is a portable and lightweight soccer practice net that can be quickly attached to and removed from an existing soccer goal frame by one person. The net consists of a generally nonelastic material with webbing straps attached to its perimeter to strengthen the edges of the net. By adjusting the tension in the webbing straps, the tension of the net may be varied to allow different soccer drills to be practiced. The practice net is capable of withstanding high tension forces in excess of 350 pounds to rebound soccer balls at nearly the same speed with which they strike the practice net.

5 Claims, 2 Drawing Sheets

SOCCER GOAL PRACTICE NET

TECHNICAL FIELD

This invention generally relates to sports training equipment and in particular to a soccer training device that will rebound a kicked soccer ball. The practice net of this invention is adjustable, uses high-tensile loads, and attaches to any existing goalpost quickly and easily without the use of tools or hardware. Furthermore, the degree of tension applied to the net may be varied to alter the rebounding characteristics of the net and to allow different drills to be practiced.

BACKGROUND INFORMATION

An important skill in soccer that must be practiced quite often is kicking a soccer ball into a goal. The ideal situation for practicing this skill would include, upon a shot on goal being taken by a player, a rapidly returning ball to allow the player to take another shot immediately, correcting any error present in the previous shot. The higher the frequency of shots taken, the more effective the regimen becomes for perfecting technique. It is difficult for a player to practice this skill, however, because following a shot, the ball must be retrieved from the goal before another shot is taken, reducing the frequency with which shots may be taken.

Also, during a soccer game, the opposing team's goalie will often block a shot on goal, causing the ball to rebound toward the player shooting the goal. The goal shooter must then react quickly to kick the rebounded soccer ball back toward the goal. This aspect of the game is difficult to practice because it requires the player who is shooting goals to practice with a willing goalie skilled in deflecting the ball.

One solution to these problems has been to develop practice goal structures consisting of a framework with a net attached to the front surface. When the player shoots the ball into the goal, the ball bounces off the net back toward the player. These structures are difficult to transport singlehandedly and take a long time to set up and take down. Furthermore, these devices often use a loose net that dissipates much kinetic energy, and results in a slowly rebounded ball.

Another solution to this problem has been to attach a rebounding net to the front of an existing soccer goal. Rebounding nets designed to attach to existing goals have not, however, provided sufficient tension to rebound balls fast enough or far enough away from the goal to allow the practice of some drills. Some nets designed to attach to existing goals have attempted to solve this problem by incorporating rigid frame members, which, while still not rebounding soccer balls with sufficient speed or distance, resulted in a more bulky device.

Therefore, a practice net is needed that can be transported easily and attached quickly to standard soccer goal frames located on a practice or playing field. The practice net must rebound balls regardless of where they hit the net and provide sufficient tension across the face of the goal so that soccer balls striking the net will be rebounded with enough speed and distance to allow the practice of certain drills.

SUMMARY OF THE INVENTION

The invention is a soccer goal practice net consisting of a generally nonelastic material such as NYLON® or POLYPROPYLENE® with dimensions sized to cover the opening of a regulation soccer goal. To strengthen the net, webbing straps are attached to the vertical edges of the net. To the vertical webbing straps are attached a number of loops of webbing material, each loop having a fastener that enables the loop to be broken apart and fastened around one of the vertical goalposts. The loops and fasteners may be cinched to create tension across the net. By adjusting the tension in the loops, the resulting tension in the net may be varied to change the speed and force with which a ball rebounds from the net to suit the skill of the player who practices with it.

It is important that a ball striking the practice net near its upper or lower horizontal edges not deflect the edge of the net and travel into the goal. Therefore, generally nonelastic horizontal webbing straps are loosely woven along and through the upper and lower horizontal edges of the net and attached at the upper and lower ends of the vertical webbing straps. The horizontal webbing straps provide additional tension and strength across the upper and lower edges of the net. To the horizontal webbing straps are attached a tension-lock fastener that may be cinched independently from the loops attached to the vertical goalposts. The loops may be cinched independently from the loops attached to the vertical webbing straps to provide tension in the horizontal webbing straps. Therefore, even when the tension in the practice net is relatively low, the tension in the horizontal webbing straps may be sufficiently high to ensure that a ball striking the net near an upper or lower edge will rebound and not travel past the net and into the goal.

The practice net of the present invention offers a number of advantages. First, the practice net is capable of providing high tension to rebound soccer balls at high speed so they will be rebounded a long distance. The practice net is capable of withstanding tension forces in excess of 350 pounds. The high tension ensures that little energy is dissipated when the ball strikes the practice net, allowing the ball to rebound with nearly the same speed at which it struck the practice net.

The second advantage offered by the present invention is that great tension may be applied by people without much strength. The tension in the net will typically be in excess of 100 pounds and may be as high as about 350 pounds. A person without great strength can exert these forces because each loop need contribute only a fraction of the overall tension. For example, in the preferred embodiment of seven loops attached to each vertical webbing strap, in order to exert a total of about 350 pounds, each loop need contribute only about 50 pounds of force. The greater the force used to cinch the loops, the greater the resulting force in the net. The ultimate tension load the net is able to withstand without tearing is in excess of 600 pounds.

The third advantage of the present invention is that the tension on the net is variable. In addition to providing a high-tension net, the invention can also provide a low-tension net that allows the practice of different drills. The low-tension net still will not allow balls to deflect the edge of the net and travel into the goal. This is accomplished by providing independent adjustment of the tension in the horizontal webbing straps that does not affect the tension in the net. Therefore, when the tension in the net provided by the loops attached to the vertical webbing straps is low, the tension applied to the horizontal webbing straps can still be high. The high tension in the horizontal webbing straps will ensure that when struck by a soccer ball, the upper or lower horizontal edge of the net will not deflect and allow the soccer ball to travel into the goal.

A fourth advantage of the present invention is that it can be used simultaneously from opposite sides of the net. This allows a single goalpost and practice net to be used by different groups of players.

The last advantage of the present invention is that the practice net has no loose parts that need to be assembled. Also, the practice net may be transported in a small backpack or carrying bag and installed quickly by one person, as follows. In attaching the net to a goal frame, first the top loop is attached to the vertical goalposts and cinched tightly enough to prevent the loop from slipping. The process is repeated for the rest of the loops attached to the vertical webbing straps. After all the loops connected to the vertical webbing straps have been attached, the horizontal webbing straps are cinched to provide adequate tension at the horizontal edges of the net. The time required to install the practice net is less than five minutes, and the time required to remove the net is less than one minute.

Finally, the present invention will allow the practice of soccer skills in a way previously not possible. By increasing the frequency with which shots may be taken and simultaneously providing immediate follow-up correction, players will achieve an effective regimen for perfecting technique. Removing the requirements of retrieving soccer balls and having other players assist allows coaches to achieve an economy of effort and efficiency previously not possible.

The advantages that the invention provides over and above existing practice net systems will become better understood with the aid of the following description, which is to be read in conjunction with the accompanying drawings.

BRIEF DESCRIPTION OF THE DRAWINGS

In the drawings, reference numerals refer to corresponding parts throughout the various views.

BEST MODE FOR CARRYING OUT THE INVENTION

Figure 1:
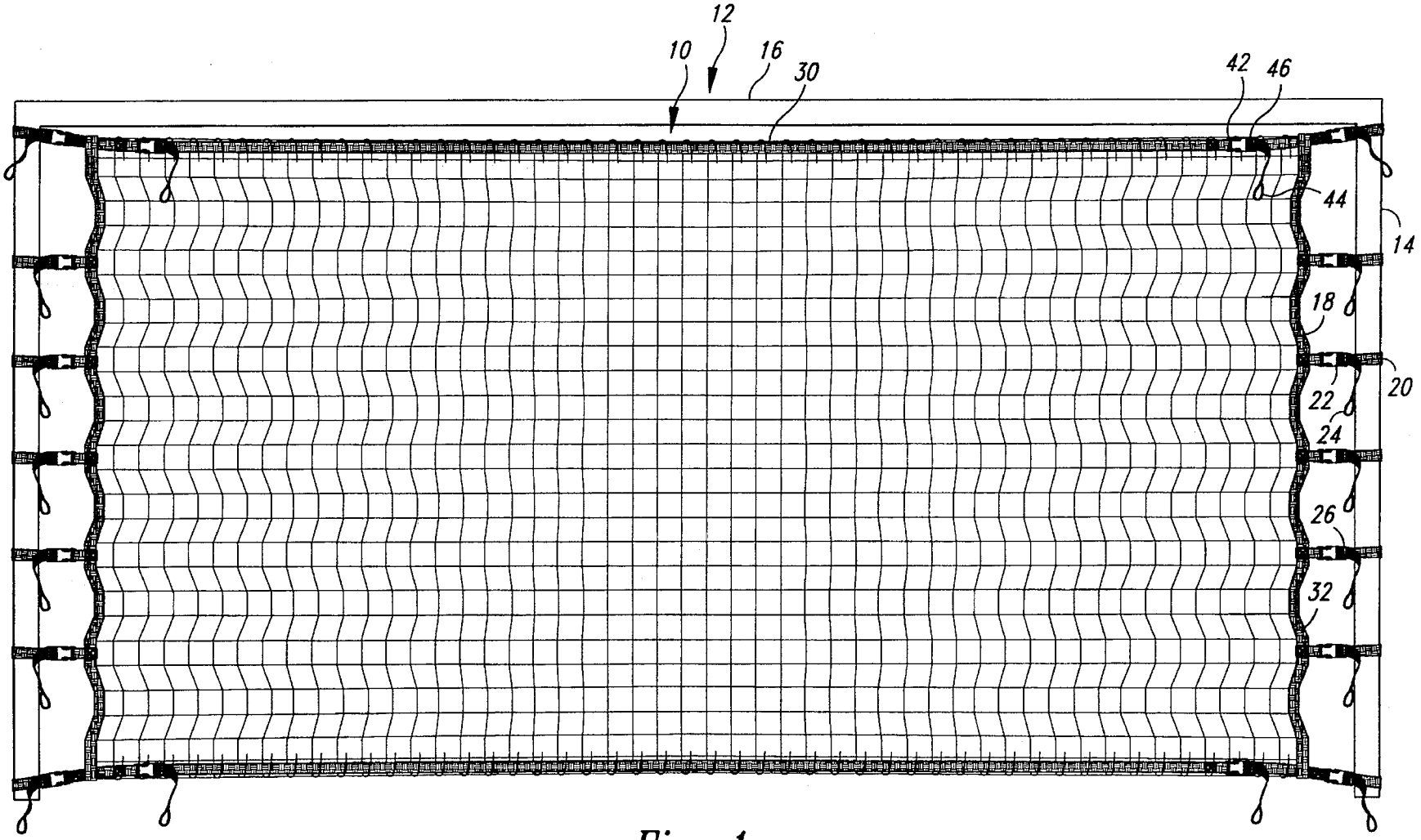
FIG. 1 is a frontal view of the assembled soccer practice net.
Figure 5:
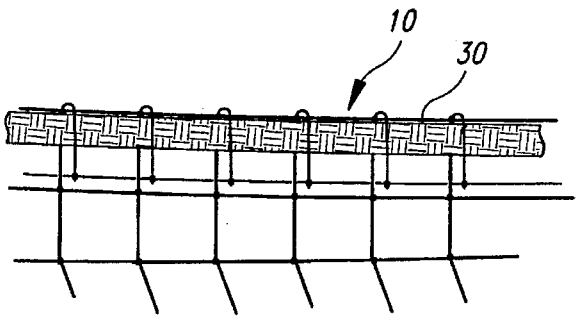
FIG. 5 is a fragmentary view of the net shown in FIG. 1 and the details of the connection of a horizontal webbing strap to the practice net.

Shown in FIG. 1 is a practice net constructed in accordance with a preferred embodiment of the invention. The practice net 10 is designed to be used with an existing soccer goal frame 12. The frame 12 generally takes the form of an inverted "U" and includes a pair of spaced-apart side posts 14 and an overhead crossbar 16 connected to and spanning the distance between the side posts.

The practice net 10 is rectangular and, when stretched, has a width and height of substantially the same dimensions as the opening defined by the goalpost frame 12. The net 10 is made of a lattice of knotted or woven fibers similar to those used with standard soccer goals or other net applications. The fibers forming the net may be natural, synthetic, or blends of those fibers.

The dimensions of a standard soccer goal are approximately 8 feet high and 24 feet wide. In order to have similar dimensions when stretched, the unstretched practice net 10 should be approximately 9 feet high and 20 feet wide. As the practice net is stretched, the lattice forming the net will also stretch, forming rectangles, with the horizontal edges longer than the vertical edges.

By placing the net under high tension, little energy is dissipated when the soccer ball is rebounded. As the ball strikes and deflects the net, the kinetic energy of the ball is converted into potential energy in the net. Then as the net springs back to its original state, the potential energy in the net is transferred to the ball in the form of kinetic energy. The percentage of energy lost is a function of the tension in the net. By varying the tension in the net, the amount of energy dissipated by the net can be increased or decreased, resulting in a change of rebound speed and range of the soccer ball.

Figure 2:
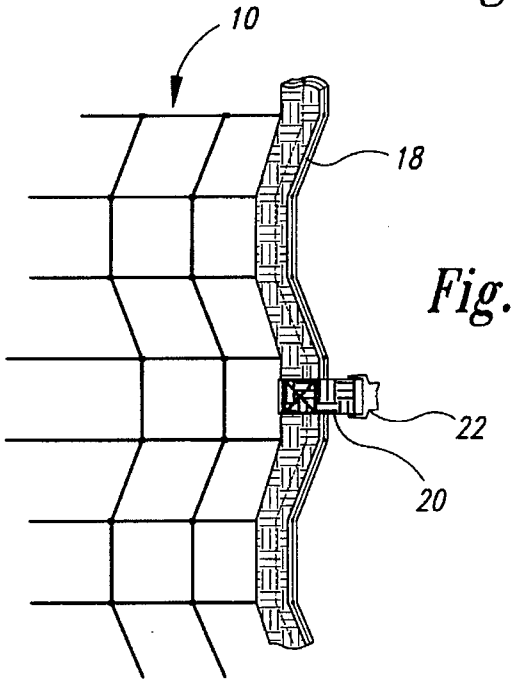
FIG. 2 is a fragmentary view of the net shown in FIG. 1 and the details of a vertical webbing strap that is connected to the practice net.

To the vertical side edges of the net 10 are sewn vertical webbing straps 18. The material used for the vertical webbing straps is a generally nonelastic durable cloth, such as NYLON®, which is woven to withstand high tensile forces without stretching or tearing. The vertical webbing straps 18 are attached to the vertical side edges of the net by placing the vertical side edges of the net between two vertical webbing straps and sewing the vertical webbing straps and the net together. As best shown in FIG. 2, the vertical webbing straps 18 are typically stitched along their lengths to adequately secure the net 10 between the vertical webbing straps.

Loops 20 of webbings or a similar generally nonelastic material are sewn to each vertical webbing strap 18 at spaced-apart locations along its length. Typically, the loops 20 will be made from the same material as the vertical webbing straps 18. The loops 20 may be attached to the vertical webbing straps 18 by stitching each loop to the vertical webbing straps and net. As best shown in FIG. 2, the stitching pattern used to stitch the loop to the webbing strap may be in the shape of an "X," known as a "box 'X' stitch" or "modified box 'X' stitch." The loops 20 attach to the vertical goalposts 14 on each side of the net. Each loop 20 has a releasable fastener 22 and a means 26 for cinching the loop and applying a tensile force to the vertical webbing straps 18.

Figure 4:
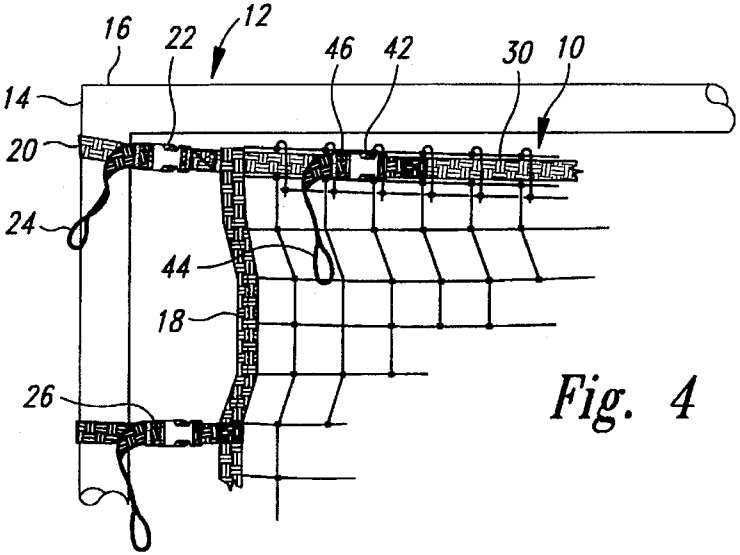
FIG. 4 is a fragmentary view of the net, like FIG. 3.
Figure 3:
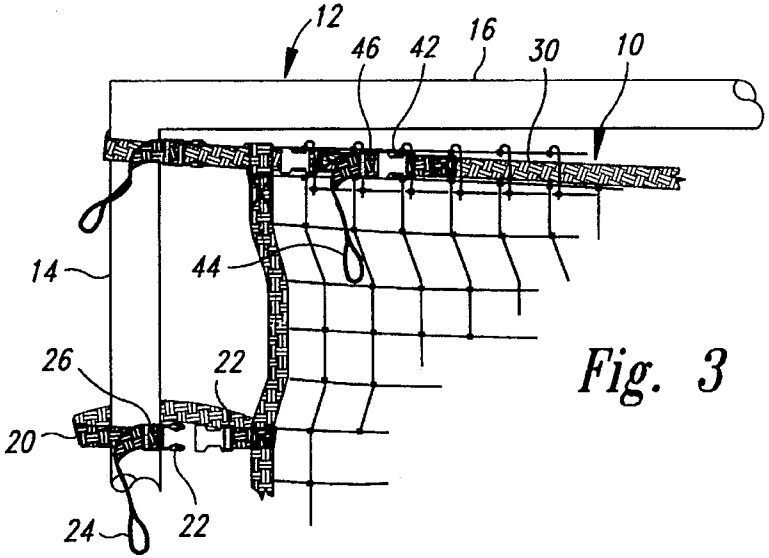
FIG. 3 is a fragmentary view of the net shown in FIG. 1 and shows the details of horizontal and vertical webbing straps that are connected to the practice net and that connect the net to a goal frame.

As best shown in FIGS. 3 and 4, one such fastener 22 is a side-actuated plastic fastener with a male connector on one end of the loop 20 and a female connector on the other end of the loop. After the male and female portions are engaged, as shown in FIG. 4, the loop 20 may be cinched by pulling on the end 24 of the loop passing through the cinch means 26.

When the loops 20 are cinched, tension is applied to the vertical webbing straps 18 and therefore also to the net 10. Each loop when cinched applies a portion of the total tension to the net. The tighter the loops are cinched, the greater the resulting tension in the net.

To the upper and lower horizontal edges of the net 10 are attached horizontal webbing straps 30. As best shown in FIGS. 3 and 4, the row of lattices nearest the horizontal edges of the net is folded over so that it aligns with the adjacent row of lattices. The horizontal webbing straps 30 are then loosely woven through both rows of lattices.

The horizontal webbing straps 30 are attached to the vertical webbing straps 18 by means of an adjustable tension-lock fastener 46 that is sewn to the vertical webbing straps using a "box 'X' stitch" providing a means of cinching the horizontal webbing straps independently from the loops attached to the vertical webbing straps. The cinch means 46 may be similar to the cinch means 26 used to apply tension to the loops 20. The end of the horizontal webbing strap 30 may be pulled through the cinch means 46, thereby applying a tension force to the horizontal webbing strap. The direction in which the end of the horizontal webbing strap is cinched may be opposite from the direction in which the loops 20 are cinched. The tension in the horizontal webbing straps may be adjusted independently in each strap and independently from the tension applied to the vertical webbing straps.

To install the practice net 10 onto the goal frame 12, the user first attaches the top loops 20 to the vertical side posts 14. Each loop 20 below the previously attached loop is then attached to the vertical side posts 14 until all loops 20 are attached to the vertical side posts. No loops need be attached to the horizontal crossbar 16.

After the practice net 10 is attached to the goalpost frame 12, the tension in each of the loops 20 and in the horizontal webbing straps 30 may be independently adjusted. By independently adjusting the tension in the loops 20, the resulting tension in the practice net may be varied.

In order to practice different soccer skills, different degrees of tension must be applied to portions of the practice net 10. The primary use of the practice net will be under high tension to rebound balls at nearly the same speed at which they struck the net. Sometimes, however, a player will want to practice taking shots a few feet from the goal and will desire a slower rebound and therefore use a low-tension net. In order to accommodate these different needs, the tension in the practice net can be adjusted to provide a practice net with varying responses.

The forces and tensions discussed herein are approximate values only and the person installing the net need not accurately measure the force applied to the loops, but instead will vary the force applied until the net appears to have sufficient tension for the drill to be practiced. The tension can be easily adjusted if necessary to better practice the drill or to practice a different drill.

Many soccer drills require a net having a high-tension force of 200 to 350 pounds or more, depending on the strength of the individual installing the net. For a practice net having seven loops 20 attached to the vertical webbing straps 18, to achieve a high-tension net, the tensile force applied to each loop will typically be about one-seventh of the total tension desired to be applied to the net. The tension in the horizontal webbing straps 30 should be sufficiently high, typically at least 50 pounds, to prevent a soccer ball striking the net near the horizontal edges of the net from passing into the goal between the net and the goal frame or ground.

A high-tension net will not deflect very much when struck by a soccer ball. Therefore, a ball striking a high-tension practice net will be rebounded with approximately the same speed at which it struck, much the same as when a ball strikes a hard surface like a wall. A high-tension net will provide faster and longer rebounds than a low-tension net.

To provide a practice net that will rebound a kicked soccer ball only a few feet, a low degree of tension should be applied to the net. To provide a low-tension net, the total tension force applied to the practice net through all the loops 20 should be less than about 100 pounds.

With a low-tension net, it is still important that the horizontal webbing straps 30 have high tensile forces applied to them. The high tension in the horizontal webbing straps 30 will ensure that a soccer ball striking the practice net near the top or bottom edge will not deflect and pass into the goal between an edge of the soccer net and the goal frame or ground. The tension in the horizontal webbing straps should typically be at least 50 pounds.

By including an upper horizontal webbing strap 30 capable of withstanding high tension, the soccer practice net 10 does not require loops attached to the overhead horizontal crossbar 16 as are used by other practice nets to prevent soccer balls from passing into the goal over the top of the practice net. By eliminating the requirement for attachments to the overhead crossbar 16, the time required to install and remove the soccer practice net 10 from the goal frame 12 is significantly decreased. The soccer net can be installed onto a goal frame by one person in less than five minutes and can be removed by one person in less than one minute.

The soccer net is constructed of pieces sewn together and integral with each other, and there are no loose parts that could be lost. The entire soccer practice net, including a carrying bag, weighs less than ten pounds. When removed from a goal frame, it may be folded to fit into a small duffel bag having a volume of approximately two cubic feet. This allows a single person to easily transport the soccer practice net.

It is to be understood that the preceding description sets forth the best mode for carrying out the invention as it is presently known. It is conceivable that other embodiments of the invention may be developed in the future. Accordingly, the spirit and scope of the invention is not to be limited by the preceding description. Instead, it is to be limited by the following patent claims, the interpretation of which is to be made in accordance with the established doctrines of patent claim interpretation.

What is claimed is:

1. A soccer practice device for use in connection with a soccer goal frame, the goal frame having a pair of spaced-apart side posts and an overhead crossbar connected to and spanning the distance between the side posts, the practice device comprising:

a rectangular net having a predefined height and width relative to the goal frame, so that when the net is in use, a lower horizontal edge of the net is positioned adjacent the ground on which the goal frame rests and an upper horizontal edge of the net is positioned adjacent the overhead crossbar, and further, the net having a pair of vertical side edges;

a pair of nonelastic vertical webbing strips, one vertical webbing strip each being connected to and along one vertical side edge of the net and a plurality of spaced-apart nonelastic loops connected to each vertical webbing strip, each loop being made of a nonelastic material and having cinch means for adjusting the size of the loop, each cinch means being capable of withstanding at least 50 pounds of tensile force, and further, each loop having means for being connected to and released from one of the side posts, so that the loops connected to each vertical webbing strip cooperate to connect the vertical side edges of the net to the side posts of the goal frame; and a pair of horizontally extending webbing strips, wherein one of the horizontal webbing strips is loosely woven along the lower horizontal edge of the net and the other horizontal webbing strip is loosely woven along the upper horizontal edge of the net.

2. The device of claim 1, wherein the plurality of loops connected to each vertical webbing strip comprises seven loops.

3. The device of claim 1, wherein the net is approximately 20 feet wide and 9 feet high when unattached to the goal frame, and approximately 24 feet wide and 8 feet high when the net is attached to the goal frame.

4. A soccer practice net for use in connection with a soccer goal frame, the goal frame having a pair of spaced-apart side posts and an overhead crossbar connected to and spanning the distance between the side posts, the practice net comprising:

a rectangular net having a predefined height and width relative to the goal frame, so that, when in use, a lower horizontal edge of the net is positioned adjacent the ground on which the goal frame rests and an upper horizontal edge of the net is positioned adjacent the overhead crossbar, and further, the net having a pair of vertical side edges; and means for attaching the vertical edges of the net to the side posts for the purpose of applying a variable amount of horizontal tensile force to the net of up to about 350 pounds of force.

5. The practice net of claim 4, including a webbing strip attached to each vertical side edge of the net, and wherein the means for attaching the vertical edges of the net to the side posts comprise a plurality of loops connecting the webbing strip to one of the side posts, each loop having a quick release fastener.

* * * * *